United States Patent [19]

Henderson

[11] 4,046,072

[45] Sept. 6, 1977

[54] PRINTING DIE ROTARY GLUING TABLE

[76] Inventor: Joseph E. Henderson, 5422 Spahn Ave., Lakewood, Calif. 90713

[21] Appl. No.: 755,801

[22] Filed: Dec. 30, 1976

[51] Int. Cl.[2] ..... B41F 27/12; B41F 27/14

[52] U.S. Cl. ..... 101/415.1; 101/DIG. 12

[58] Field of Search ..... 101/DIG. 12, 212, 216, 101/219, 401.3, 415.1, 401.1, 131, 131.5, 132, 132.5, 378; 33/184.5

[56] References Cited

U.S. PATENT DOCUMENTS

| | | | |
|---|---|---|---|
| 2,539,965 | 1/1951 | Moss et al. | 101/216 |
| 2,907,274 | 10/1959 | Taylor | 101/DIG. 12 |
| 3,186,336 | 6/1965 | Kirby | 101/DIG. 12 |
| 3,361,060 | 1/1968 | Hoexter et al. | 101/216 |

*Primary Examiner*—J. Reed Fisher

*Attorney, Agent, or Firm*—Fulwider, Patton, Rieber, Lee & Utecht

[57] ABSTRACT

There is disclosed a rotary, work-support table having a plurality of interchangeable cylindrical work-support members which are removably mounted on a frame having end plates with bearing supports to receive bearing means carried on stub shafts of the cylindrical members. The device is useful as a work table for supporting a flexible sheet (make-ready) during the bonding of the flexible printing dies thereto.

4 Claims, 1 Drawing Figure

PRINTING DIE ROTARY GLUING TABLE

BACKGROUND OF THE INVENTION

1. Field of the Invention

This invention relates to a work table and, in particular, to a rotary work table for bonding of printing dies to flexible sheet material carrier.

2. Brief Statement of the Prior Art

High speed printing machines such as are used for the printing of cardboard boxes and the like have rotary mandrels on which the printing dies are mounted with a flexible sheet material (make-ready) as a carrier. The printing dies are molded rubber mats approximately one quarter to three sixteenths inch in thickness and are bonded to the flexible sheet which is typically of vinyl plastic, approximately 30 mils in thickness for mounting in the printing machine.

Heretofore, the flexible carrier sheets (make-ready), are placed on a flat work table, the location of the printing dies on the make-ready are plotted and the flat, rubber printing dies are bonded or cemented to the make-ready sheet while the latter is in a flat position on the work table.

The bonding of the printing dies to the make-ready sheet while the latter is on a flat table often causes difficulties in mounting of the make-ready to the rotary drum of the printing machine since the laminated assembly lacks adequate flexibility, often resulting in inadequately bonded edges of the printing dies which release from the make-ready sheet and extend above the cylindrical plane of the printing drum a sufficient distance that they transfer ink to the printed, flat work piece. This tendency becomes more pronounced with age and use of the printing dies since the make-ready and printing die assembly often tends to curl during storage in an opposite direction from its curvature when mounted on the printing drum.

While some attempts have been made to bond printing dies to make-ready sheets while supporting the sheets on a cylindrical work support, this approach has not been widely accepted since there is no single standard or fixed diameter for a printing drum and, consequently, the make-ready and printing die assembly must often assume curvatures of widely varied radii.

BRIEF DESCRIPTION OF THE INVENTION

This invention comprises a rotary work support useful in supporting the flexible make-ready sheets used in high speed printing machines while bonding flat rubber printing dies thereto. The invention comprises a support frame having distal, vertical end plates that carry bearing supports which, preferably, are a pair of V-oriented blocks which receive bearing races that provide bearing support for distal shafts of any one of a plurality of interchangable cylindrical work-support members. In the preferred embodiment, the frame is provided with drive means having a driven gear carried inboard on one of the end plates and each of the cylindrical work-support members bears a driven gear which interconnects with said driving gear when the respective cylinder is mounted in the frame of the device. The bearing support means carried on the end plate is preferably fixedly adjustable to permit fixed adjustment in reception of the bearing means to prevent excessive loading on the shafts of the drive mechanism including the drive motor.

BRIEF DESCRIPTION OF THE DRAWINGS

The invention will be described with references to the illustrations of which.

DESCRIPTION OF THE PREFERRED EMBODIMENTS

Figure 1:
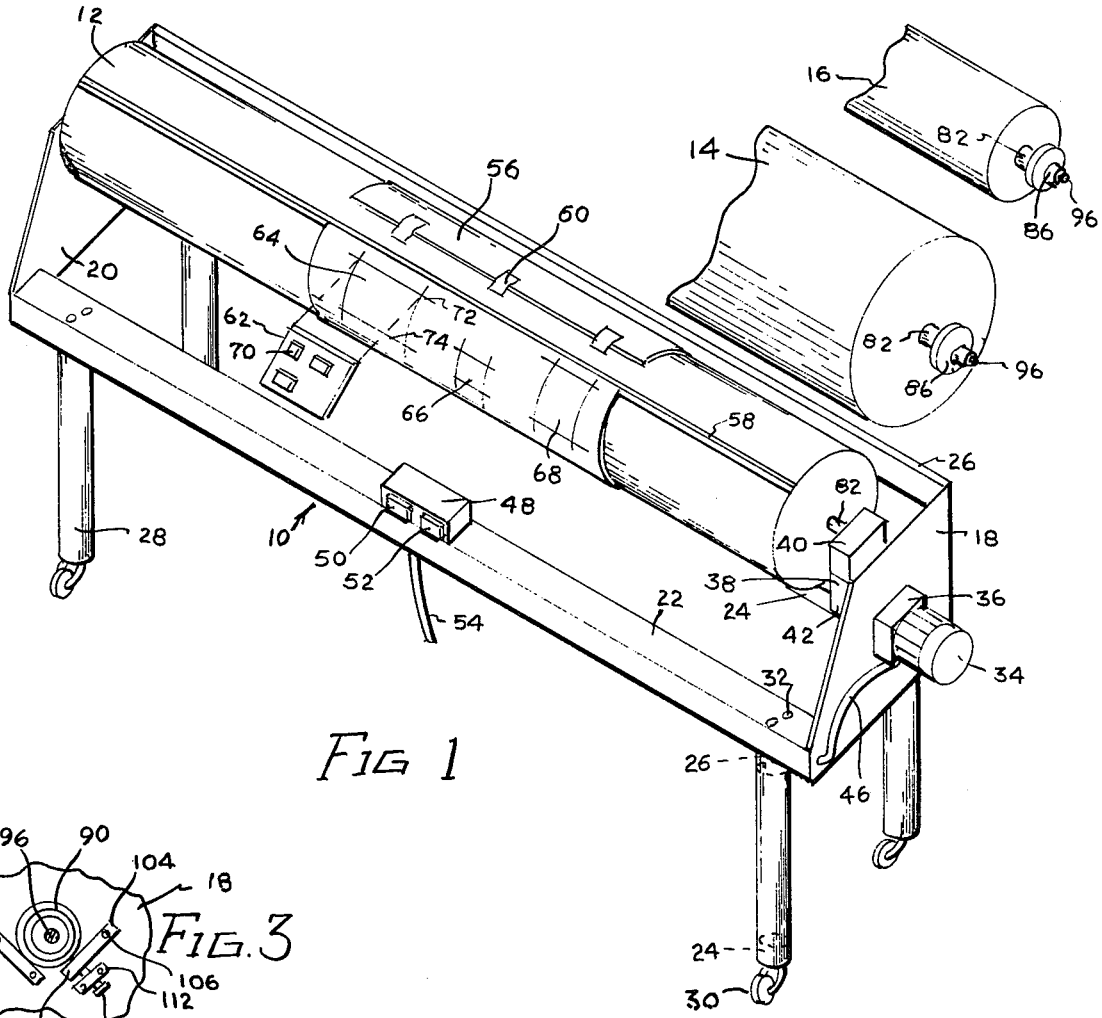
FIG. 1 is a perspective view of the device of the invention.

Referring now to FIG. 1, the invention comprises a rotary work support device formed of a frame 10 and a plurality of interchangable cylindrical work-support members 12, 14 and 16. The frame 10 is formed of distal plates 18 and 20 interspaced by longitudinal spar members 22, 24 and 26 and the resultant assembly is supported on vertical legs 28.

While the particular construction of the frame can be varied as desired, the preferred construction employs flat sheet end plates with channel longitudinal spar members and tubular support legs. The tubular support legs can bear distal plugs 24 and 26 which can be press-fitted into the tubular legs. The lowermost plug 24 can have a central bore to receive the shaft of a caster 30 and the like while the upper plug can have internally threaded bores to receive bolt fasteners 32 and the like for securing the legs to respective longitudinal spar members.

One end plate member 18, carries drive means such as prime mover 34 which is mechanically linked to cylindrical work-support member such as 12 mounted on frame 10. The drive means includes suitable gear reduction means 36 and a safety enclosure housing 38 having a hinged cover 40 and a lower box 42 carried on end plate 18.

The prime mover can be an electrical motor supplied with electrical power through conductors in rigid conduit 46 that extends to control box 48 which houses a pair of pressure responsive switches 50 and 52 which are connected in the power supply electrical cord 54.

As illustrated in FIG. 1, the rotationally mounted, cylindrical, work-support members such as 12 have means for the removeable attachment of a flexible, make-ready sheet 56. The attachment means comprises longitudinal channel member 58 carried on the periphery of the cylindrical work member which receives a reverse-folded edge of the flexible make-ready sheet 56. The flexible make ready sheet is wrapped over the cylindrical surface of the work support member 12 and can be secured thereto by suitable means such as adhesive tape 60.

In assembly, the flexible, make-ready sheet is preferably placed on a flat work support and the positions of the printing dies are scribed thereon as shown at 64, 66 and 68. These scribed areas, after the flexible make-ready sheet is mounted on the cylindrical work support member 12, are coated with a suitable cement such as contact rubber adhesive and the like which is also coated on the undersurface of a printing die such as 62.

The printing dies which are employed are conventionally manufactured as flat mats of molded rubber bearing an intaglio face 70 of the desired printed matter. Commonly, these rubber printing dies are from one-eighth to about three-sixteenths inch in thickness.

In the mounting of the printing dies on the flexible make-ready sheet, either a leading or trailing edge such as 72 or 74 of a plotted area is used as a reference line and the edge of the printing die is aligned closely to this reference line. It will be found that as the die is bowed to the cylindrical contour of the flexible make-ready sheet that the opposite edge does not align precisely with the opposite edge of the plotted area because of the thickness of the printing die. Accordingly, if the leading edge of a plotted area is selected as the reference line, all the leading edges of the other plotted areas should likewise be used as the reference line for alignment of the remaining printing dies to be mounted on the flexible make ready sheet.

An essential element of the invention comprises the plurality of interchangable cylindrical work-support members such as 12, 14 and 16. As apparent from FIG. 2, each of these members is of hollow-form construction, formed with a cylindrical shell 76 that can be manufactured of a suitable material such as plastics, e.g., fiber glass, reinforced polyester or epoxy resins and the like, with distal plates 78 to which are secured stub shafts such as 82. The stub shafts extend through end plates such as 78 and are secured to face plates 84 by welding and the like. Screws or rivet fasteners 86 secure the face plates to the end plates. Preferably, a stub shaft on one end of each cylindrical work-support member bears a driven gear 86 carried thereon by locking means such as a woodruff key, conical wedge lock or other conventional means. The gears 86 are identical to permit interchangeability of the cylindrical members 12, 14 and 16.

Each stub shaft 82 has means to receive bearing means such as a cylindrical bearing race 90 and the like and to retain such bearing means at a fixed distal position thereon. This can be achieved by providing a reduced diameter neck portion 96 for each shaft which receives the bearing race.

Figure 2:
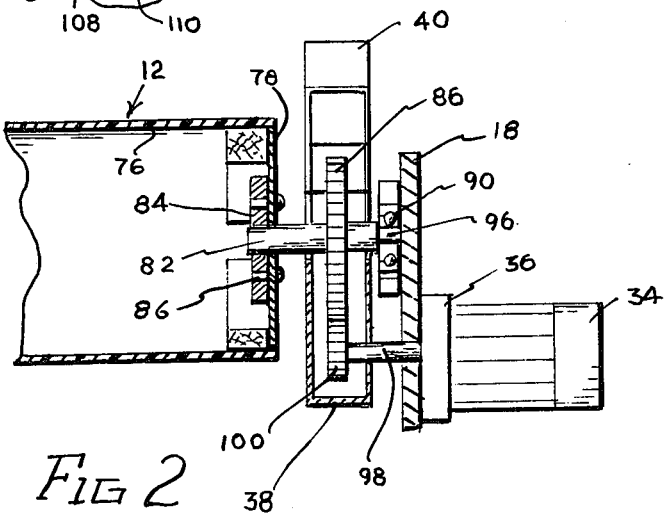
FIG. 2 is a partial sectional view of the driven end of a cylindrical work-support member.

As shown in FIG. 2, the cover 40 of the safety box 42 is open, exposing the gear 86 on stub shaft 82. The drive motor 34 and its associated gear reduction means 36 are carried on end plate 18 and a drive shaft 98 projects through the end plate 18 to support driving gear 100. The driven gear 86 on stub shaft 82 is supported by bearing race 90 to interengage with driving gear 100.

Figure 3:
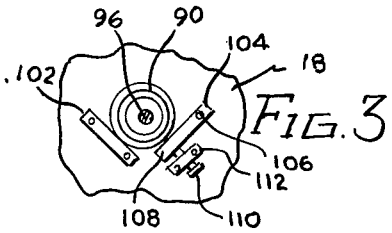
FIG. 3 is a view along lines 3—3 of FIG. 2.

As apparent from FIG. 3, the bearing support for bearing race 90 comprises a pair of V-disposed blocks 102 and 104. One of the blocks 102 is fixedly carried on end plate 18 while the other block is pivotally secured thereto by pin 106 with its lower end 108 resting on adjustment means in the form of machine screw 110 that is threadably mounted in abutment block 112. Advance or retraction of the machine screw 110 in the abutment block 112 thus permits a variable adjustability in the vertical position of bearing race 90 between the blocks 102 and 104, permitting the interchange of cylinders 12, 14 and 16 while avoiding any vertical loading on driving gear 100.

Figure 4:
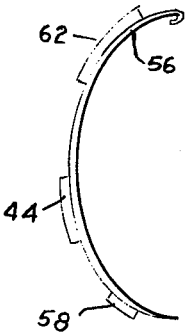
FIG. 4 is an end view of a typical make ready-printing die assembly in its relaxed position.

FIG. 4 illustrates the relaxed contour which is assumed by the assembly of the flexible make-ready sheet 56 and the adhesively mounted printing die mats 62, 44 and 58 when the assembly is mounted on cylindrical work support member such as provided by the invention. This naturally bowed contour to the assembly greatly facilitates the mounting of the assembly on the drums and rollers of the printing apparatus as well as insures that the edges of the relatively stiff printing die mats do not separate and project into the plane of the printing die characters or relief portions.

The invention has been described with reference to the presently preferred and illustrated embodiment thereof. It is not intended that the invention be unduly limited by this description of the preferred embodiment. Instead, it is intended that the invention be defined by the means, and their obvious equivalents, set forth in the following claims.

I claim:

1. A work support useful for gluing flexible printing dies to a flexible sheet backing which comprises:

an elongated frame having opposite, upright end plates;

a plurality of interchangeable, elongated cylindrical work-support members with coaxial end shafts projecting from each end thereof and a longitudinal channel to receive the reverse lip of a flexible sheet material;

end shaft bearing means to mount on each of said end shafts;

cylindrical member support means comprising a pair of V-disposed bracket means on the inboard faces of each of said end plates to receive said end shaft bearing means;

driven gear means on one of said end shafts;

drive means mounted on said frame and having driving gear means carried on one of said end plates to mesh with said driven gear means.

2. The work support of claim 1 wherein said V-shaped bracket means comprises a pair of opposed, inclined block members.

3. The work support of claim 2 wherein one of said block members is adjustable to permit fixed adjustability in the spacing between said block members wherein the height of said bearing means in said support means is fixedly adjustable.

4. The work support of claim 3 wherein one of said block members is pivotally mounted on said end plate with variable abutment means whereby its inclination relative to the other of said block members is fixedly adjustable.

* * * * *